US005556037A

United States Patent [19]

Wood

[11] Patent Number: 5,556,037

[45] Date of Patent: Sep. 17, 1996

[54] ADJUSTABLE SPRAY HEAD

[75] Inventor: Noel S. D. Wood, Hunter's Hill, Australia

[73] Assignee: Exell Trading Pty. Limited, Glenorie, Australia

[21] Appl. No.: 569,305

[22] Filed: Dec. 8, 1995

Related U.S. Application Data

[63] Continuation of Ser. No. 240,654, filed as PCT/AU92/00606, Oct. 11, 1992, published as WO93/09876, May 22, 1993, abandoned.

[30] Foreign Application Priority Data

Nov. 11, 1991 [AU] Australia ..... PK9408

[51] Int. Cl.[6] ..... B05B 1/32; B05B 1/14

[52] U.S. Cl. ..... 239/458; 239/539; 239/565

[58] Field of Search ..... 239/548, 565, 239/587.1, 589, 596, 456–458, 539; 285/319

[56] References Cited

U.S. PATENT DOCUMENTS

| | | | |
|---|---|---|---|
| 839,811 | 1/1907 | Christman | 239/458 |
| 2,250,079 | 7/1941 | McDonald | 239/456 |
| 2,797,134 | 6/1957 | Fuller | 239/539 |
| 2,938,673 | 5/1960 | Allenbaugh | 239/458 |
| 3,045,927 | 7/1962 | Gilmour | 239/458 |
| 3,104,063 | 9/1963 | Bete | 239/548 |
| 3,149,783 | 9/1964 | Sosnick | 239/491 |
| 3,363,842 | 1/1968 | Burns | 239/458 |
| 4,930,704 | 6/1990 | Chen | 239/579 |
| 5,044,560 | 9/1991 | Cheng | 239/476 |
| 5,167,431 | 12/1992 | Maifredi | 285/319 |

FOREIGN PATENT DOCUMENTS

| | | | |
|---|---|---|---|
| 482946 | 5/1952 | Canada | 239/458 |
| 339327 | of 1904 | France | 239/565 |
| 2588348 | 4/1987 | France | 239/458 |

*Primary Examiner*—Andres Kashnikow
*Assistant Examiner*—Lesley D. Morris
*Attorney, Agent, or Firm*—Abelman, Frayne & Schwab

[57] ABSTRACT

A spray head comprising a tubular body with an inlet and an outlet. A collar is located at the inlet. A cap fits over the outlet and has an end with a number of spray forming nozzles positioned in front of the outlet. The body has a protrusion having a button located on its free end. The protrusion is resiliently movable in a radial direction relative to the tubular body. The cap has a partial helical slot into which the button is receivable. The engagement of the button and slot converts rotational movement of the cap into longitudinal movement thereof, which adjusts the position of the nozzles relative to the outlet. The cap is releasable from the tubular body by radial depression of the button and disengagement thereof from the slot.

19 Claims, 2 Drawing Sheets

FIG. 1
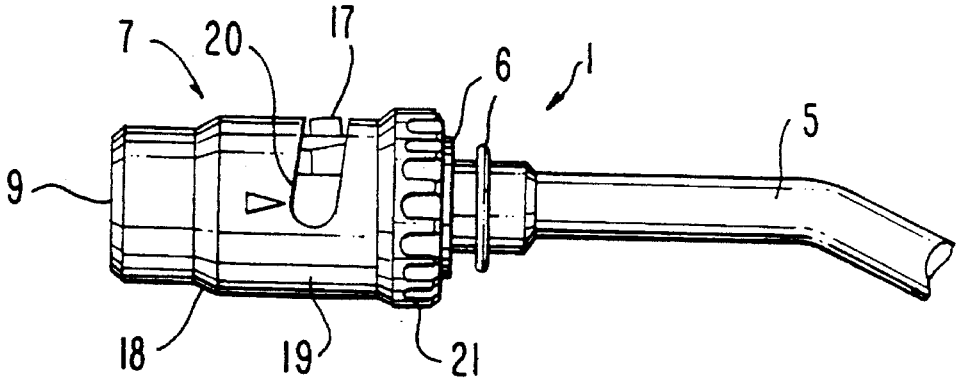
FIG. 2
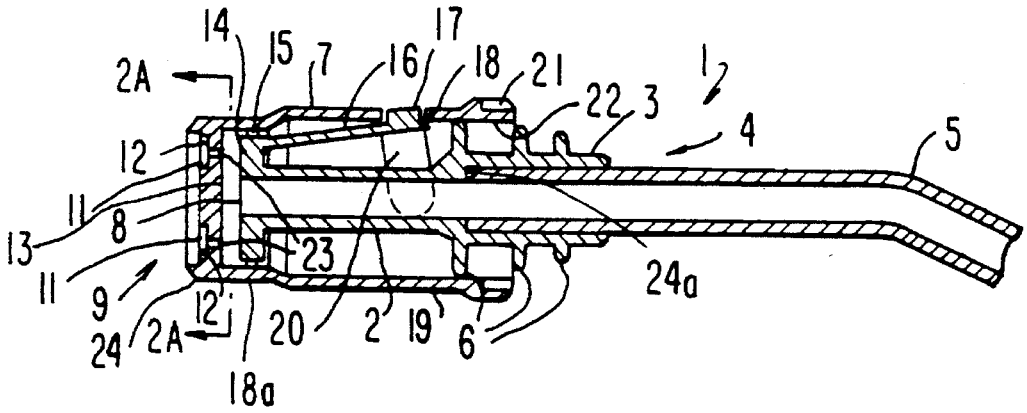
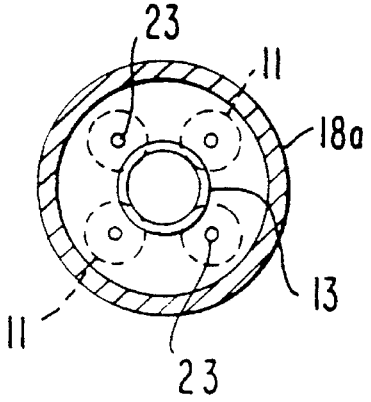
FIG. 2A

ADJUSTABLE SPRAY HEAD

This application is a continuation application under 37 C.F.R. 1.62 of prior application Ser. No. 08/240,654 filed as PCT/AU92/00606, Oct. 11, 1992, published as WO93/09876, May 27, 1993, now abandoned.

TECHNICAL FIELD

The present invention relates to spray heads having nozzles, and in particular, to a spray head which is used for a horticultural sprayer.

BACKGROUND ART

There are many known types of spray heads which can be used for horticultural sprays and the like. Different types of nozzles provide a different type of spray emanating therefrom. Most nozzles provide a spray having the shape of a cone whereby the water or liquid being sprayed forms the outside surface of the cone only. Most nozzles are adjustable to provide for finer or coarse droplets of spray as required.

Even though such described nozzles are used widely, one major disadvantage is that the spray only forms the outside periphery of a cone. Therefore when spraying the water or liquid, the center target area is left almost dry.

One known type of spray head as described in EPA363984 by Yap Yeon Cheng, provides a spray which has an even distribution of droplets throughout the middle of the cone. This particular nozzle of this spray head uses an outer disc having a plurality of nozzle holes in order to produce the even type spray.

Disadvantages of this spray head are that it is complicated to manufacture, difficult to adjust the cone angle of the spray without wetting the fingers and the nozzle disc must be rotated numerous times to effect adjustment of the spray cone angle. Furthermore, there is insufficient sealing to prevent backflow of water.

DISCLOSURE OF INVENTION

According to one aspect of the invention there is provided a spray head comprising a tubular body having an inlet and an outlet, a cap rotatably and slidably mounted on said body covering said outlet and having at least one spray forming nozzle therein, and a protrusion fixed on said tubular body and resiliently movable in a radial direction relative to said tubular body. The cap has a partial helical slot therein into which said protrusion is receivable, engagement of said protrusion and slot converting rotational movement of said cap into longitudinal movement thereof to adjust the position of said spray forming nozzle(s) relative to said outlet. The cap is releasable from said tubular body by radial depression of said protrusion and disengagement thereof from said slot.

According to another aspect of the invention there is provided spray head comprising a tubular body having an inlet and an outlet, and a cap rotatably and slidably mounted on said body covering said body and having at least one spray forming nozzle therein. The outlet has an end flange with an O-ring means located around the periphery of said flange. The O-ring means co-operates with said cap to provide a seal as the cap is moved relative to said body.

BRIEF DESCRIPTION OF THE DRAWINGS

In order that the invention may be more readily understood and put into practical effect, reference will now be made to the accompanying drawings in which FIG. 1 is a side view of the spray head of a first embodiment of the invention, FIG. 2 is a longitudinal cross-sectional view through the spray head of FIG. 1, FIG. 2A is a transverse cross-sectional view taken along the section marks 2A—2A in FIG. 2.

MODES FOR CARRYING OUT THE INVENTION

Figure 3:
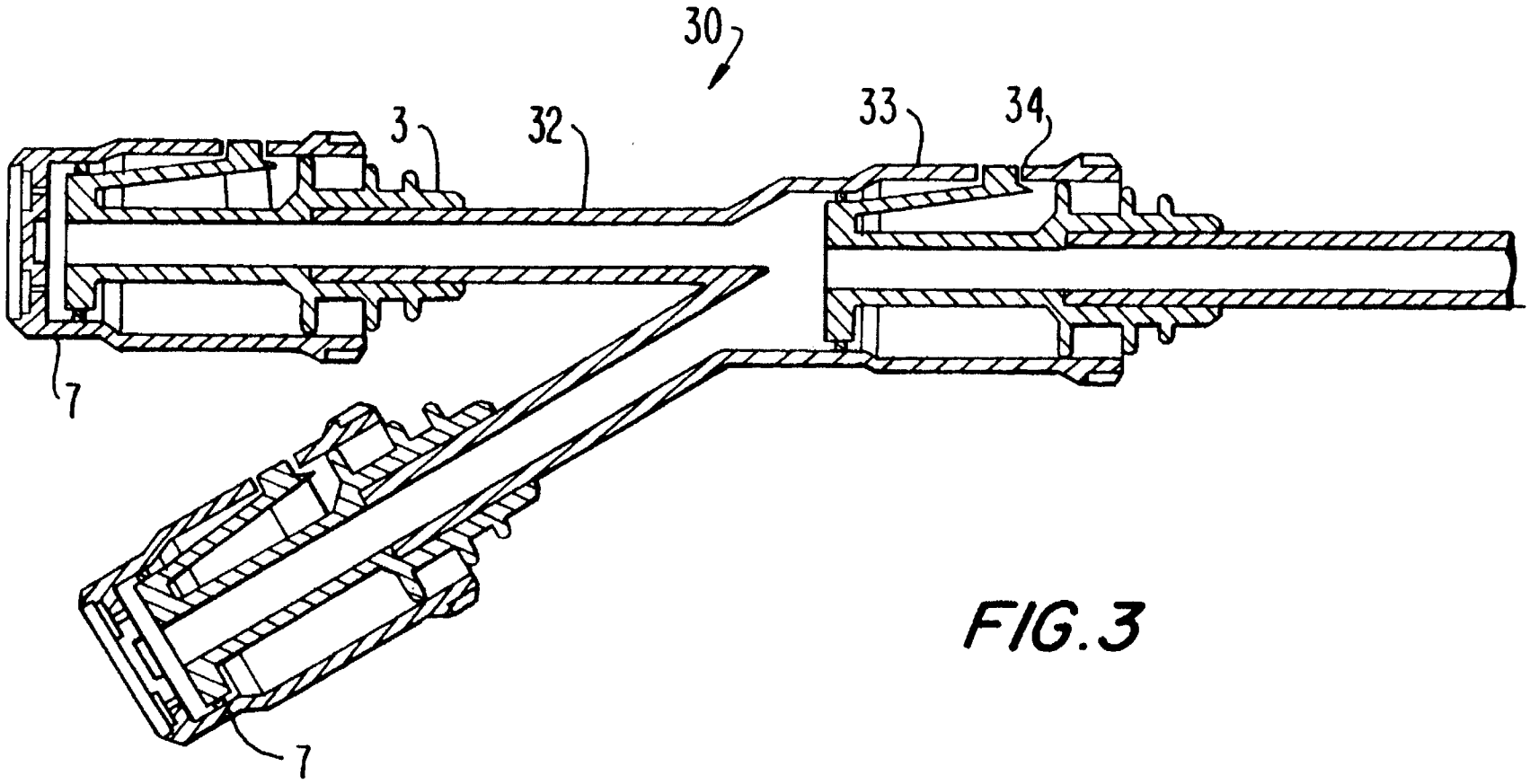
FIG. 3 is a longitudinal cross-sectional view of a double spray head of a second embodiment of the invention.

The spray head 1 of the preferred embodiment as illustrated in the drawings includes a tubular body 2 with an inlet 4 and an outlet 8. A collar 3 is located at the inlet 4. A supply tube 5 forms a friction fit with the inside surface of the collar 3, and abuts against a shoulder 24*a* located on the internal surface of the tubular body 2. The collar 3 has three annular ribs 6 located on the outside surface of the collar 3. The annular ribs 6 are provided for strength as well as providing support for a cap 7.

The cap 7 fits over the outlet 8 of the tubular body 2. The cap 7 has an end 9 with a number of apertures or spray forming nozzles 11 positioned in front of the outlet 8. The outlet 8 has an end flange 14 with an O-ring 15 located around its outside surface. The O-ring 15 abuts against the internal surface of the cap 7 and provides a pressure seal.

The end 9 of the cap 7 of the first embodiment, as illustrated in FIG. 2 has four apertures or spray forming nozzles 11 located therein. Each nozzle 11 opens into a corresponding substantially circular depression 12 on the outside surface of the cap 7. The end 9 of the cap 7 has an annular rim 24 projecting from the outside surface thereof. A further circular depression 13 is located on the inside surface of the cap 9 opposite to the outlet 6. Each nozzle 11 is connected to the circular depression 13 by a corresponding groove 23. The combination of the circular depression 13, the grooves 23, the nozzles 11, the circular depressions 12 and the annular rim 24 provide for a spray which has a distribution of droplets in the form of a solid cone.

A cantilever protrusion 16 extends from the flange 14 of the tubular body 2 and is resiliently movable in a radial direction relative to the tubular body 2. The protrusion 16 has a button 17 located on the free end 18 of the protrusion 16. The button 17 protrudes outwardly in a radial direction.

The cap 7 has a shoulder 18*a* and a main sleeve portion 19. The shoulder 18*a* is located adjacent the O-ring 15. Located in the main sleeve portion 19 is a partial helical slot 20 within which the button 17 is located. The protrusion 16 is urged against the main sleeve portion 19 and the button 17 prevents the cap 7 being removed from the tubular body 2. To remove the cap 7 from the tubular body 2, the button is depressed thus allowing the cap 7 to be moved in an axial direction away from the button 17. This allows one cap 7 to be removed and a similar cap 7 (not illustrated) having differently sized nozzle apertures 11, to be positioned on the tubular body 2.

The engagement of the button 17 and the partial helical slot 20 converts rotational movement of the cap 7 into longitudinal movement thereof. This adjusts the distance between the spray forming nozzles 11 and the outlet 8 to adjust the cone angle of the spray. Because of the coarse pitch of the slot 20, the amount of rotation of the cap 7 required to effect adjustment of the spray cone angle is minimal.

As illustrated in FIG. 1, the cap 7 has a scalloped flange 21 at its end closest the inlet 4. The internal surface 22 of the scalloped flange 21 rests on two of the annular ribs 6. This provides for a neat appearance as well as providing support for the cap 7.

A double headed spray head 30 is illustrated in FIG. 3. The double headed spray head 30 includes two spray heads 1 as described above located on a bifurcated tube 32. The bifurcated tube 32 has a sleeve 33 which duplicates the shoulder 18 and sleeve portion 19. Thus the tube 32 is able to be fitted over the tubular body 2 in a similar manner as described above. In this case, the partial helical slot 20 on the cap 7 is replaced by a circular hole 34 which receives the button 17. Thus, there is no relative rotation between the sleeve 33 and the tubular body 2.

The foregoing describes only two embodiments of the present invention, and modifications obvious to those skilled in the art can be made thereto without departing from the scope of the present invention.

INDUSTRIAL APPLICABILITY

The spray head of the invention may be used with horticultural sprayers.

I claim:

1. A spray head comprising a tubular body having an inlet and an outlet, a cap rotatably and slidably mounted on said body covering said outlet and having a plurality of spray forming nozzles therein, and a protrusion fixed on said tubular body and resiliently movable in a radial direction relative to said tubular body, said cap having a partial helical slot therein into which said protrusion is receivable, engagement of said protrusion and slot converting rotational movement of said cap into longitudinal movement thereof to adjust the position of said spray forming nozzles relative to said outlet, and said cap being releasable from said tubular body by radial depression of said protrusion and disengagement thereof from said slot.

2. A spray head according to claim 1 wherein each of said nozzles opens into a distinct substantially circular depression on an outside surface of said cap.

3. A spray head according to claim 2 wherein a further circular depression is located on an inside surface of said cap opposite said outlet, each of said nozzles being connected to the further circular depression by a corresponding groove.

4. A spray head according to claim 3 wherein said cap has at its said outside surface an annular rim.

5. A spray head according to claim 4 wherein said cap has four nozzles.

6. A spray head according to claim 1 wherein said protrusion extends from a flange at the outlet of said tubular body in a cantilevered way towards the inlet of said tubular body.

7. A spray head according to claim 6 wherein said protrusion has a button located at a free end of said protrusion, said button protruding outwardly in a radial direction and being a portion of said protrusion receivable in said slot.

8. A spray head according to claim 1 wherein said tubular body has at least one annular rib around its inlet for supporting said cap.

9. A multiple head spray including at least two spray heads as claimed in claim 1.

10. A spray head comprising a tubular body having an inlet and an outlet, and a cap rotatably and slidably mounted on said body covering said body and having a plurality of spray forming nozzles therein, wherein said outlet has an end flange with an O-ring means located around the periphery of said flange, and said O-ring means co-operates with said cap to provide a seal as the cap is moved relative to said body.

11. A spray head according to claim 10 and further including a protrusion fixed on said tubular body and resiliently movable in a radial direction relative to said tubular body and wherein, said cap has a partial helical slot therein into which protrusion is receivable such that engagement of said protrusion and slot converts rotational movement of said cap into longitudinal movement thereof to adjust the position of said spray forming nozzles relative to said outlet, said cap being releasable from said tubular body by radial depression of said protrusion and disengagement thereof from said slot.

12. A spray head according to claim 11 wherein said protrusion comprises a free end of a cantilever which extends from said flange at the outlet of said tubular body towards the inlet of said tubular body.

13. A spray head according to claim 12 wherein said free end comprises a button located at said free end, said button projecting outwardly in a radial direction and being received in said slot.

14. A spray head according to claim 11 wherein said tubular body has at least one annular rib around its inlet for supporting said cap.

15. A spray head according to claim 10 wherein each of said nozzles opens into a distinct substantially circular depression on an outside surface of said cap.

16. A spray head according to claim 15 wherein a further circular depression is located on an inside surface of said cap opposite said outlet, each of said nozzles being connected to the further circular depression by a corresponding groove.

17. A spray head according to claim 16 wherein said outside surface of said cap comprises a substantially circular end surrounded by an annular rim.

18. A spray head according to claim 17 wherein said cap has four nozzles.

19. A spray head according to claim 10 wherein said cap has a shoulder and a main sleeve portion, said shoulder co-operating with said O-ring.

* * * * *